US007038135B1

(12) United States Patent
Chan et al.

(10) Patent No.: US 7,038,135 B1
(45) Date of Patent: May 2, 2006

(54) EMBEDDED CABLE CONNECTION IDENTIFICATION CIRCUITS

(75) Inventors: Kevin Chan, Ryde (AU); Alexander Forbes, Westleigh (AU); Christopher R. Gentle, Sydney (AU)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 10/879,403

(22) Filed: Jun. 28, 2004

(51) Int. Cl.
*H01R 4/00* (2006.01)

(52) U.S. Cl. ..... 174/84 R

(58) Field of Classification Search ..... 174/36, 174/110 R, 113 R, 115, 74 R, 78; 340/815.45, 340/815.47; 439/490
See application file for complete search history.

(56) References Cited

U.S. PATENT DOCUMENTS 4,890,102 A * 12/1989 Oliver ..... 714/712
4,978,317 A * 12/1990 Pocrass ..... 439/490
5,081,627 A * 1/1992 Yu ..... 714/46
5,198,664 A * 3/1993 Fayfield ..... 250/239
5,249,183 A * 9/1993 Wong et al. ..... 370/228
5,577,023 A * 11/1996 Marum et al. ..... 370/225
5,741,152 A * 4/1998 Boutros ..... 439/490
5,764,043 A * 6/1998 Czosnowski et al. ..... 324/66
6,577,243 B1 * 6/2003 Dannenmann et al. . 340/815.45

OTHER PUBLICATIONS

Systimax website, http://WWW.systimax.com, 8 pages, printed Jun. 9, 2004.
Brooks, G., "iPatch™ System Sees into the Patch Cord Jungle," Avaya, Inc. pp. 11-12, Jun. 9, 2004.

* cited by examiner

*Primary Examiner*—William H. Mayo, III
(74) *Attorney, Agent, or Firm*—Sheridan Ross P.C.

(57) ABSTRACT

The present invention provides an interconnect cable having selectively activated identifiers in order to facilitate the locating and positive identification of ends of the interconnect cable. The identifiers may be activated by introducing or enabling a suitable activation signal at identifier activation points provided at an end of the interconnect cable opposite an end including an identifier. The activation signal may be provided by a detection probe tool.

37 Claims, 5 Drawing Sheets

EMBEDDED CABLE CONNECTION IDENTIFICATION CIRCUITS

FIELD OF THE INVENTION

The present invention is directed to the identification of patch cables.

BACKGROUND OF THE INVENTION

Electronic equipment, including communication and computer networks, relies on patch or interconnect cables to interconnect components and devices to one another. In order to facilitate troubleshooting and the reconfiguration of signal paths, it is important to carefully manage patch panels. This requires having a clear understanding of the actual interconnections that have been made, and being able to accurately identify patch cables to allow accurate interconnections and trouble shooting. In networks having a large number of interconnected components and devices, keeping track of and managing the various interconnections can become a significant problem.

One of the most common tasks in patch panel maintenance is identifying existing connections on the panel. In order to keep track of the various interconnections, paper-based documentation may be kept for the panel. With complex systems, the documentation for a patch panel can comprise a large record book in which the various connections are manually recorded. Because paper-based documentation requires the manual entry in the record book of the interconnections, the information contained in the record book often contains errors. In addition, verifying existing connections, reconfiguring connections, and/or making new connections when using paper-based documentation remains a time-consuming and error prone task. In addition, paper-based documentation is of little help when a technician needs to locate the end of a cable that has become disconnected from the patch panel, or in identifying a particular cable when a number of interconnections need to be made.

Whether or not paper-based documentation is used to record interconnections on or with a patch panel, hand tracing can be used to locate the ends of a cable. However, hand tracing can be difficult or even impossible where the patch panel has a large number of interconnected cables.

In order to facilitate the tracing of cables, wire tracing kits are available. Such kits allow the end of a cable to be positively identified by imposing a signal at the opposite end of the cable. Although such systems allow a technician to positively identify the ends of a particular cable, they do not assist in locating those ends in the first place. That is, existing wire tracing kits provide confirmation with respect to the identity of a cable, but do not assist in actually locating the end of the cable.

Electronic systems for monitoring and recording existing connections on a patch cable have also been developed. However, such systems require specialized patch panels that monitor connections at the panel, displays on the patch panel racks, and LEDs on the patch panel ports, as well as software for administering the patch panel connections. Furthermore, such systems cannot assist a technician in locating an end of a cable that has become disconnected from its port, or that is connected to a port other than the port recorded in the database as being the termination point for the cable. In addition, such systems are relatively expensive, and require that network administrators deploy and manage additional, complex tools.

SUMMARY OF THE INVENTION

The present invention is directed to solving these and other problems and disadvantages of the prior art. In accordance with embodiments of the present invention, a patch cable or interconnect cable is provided having an identifier associated with at least a first end of the patch cable. Identifier activation or probe contact points, interconnected to the identifier by identifier signal lines, are provided at the opposite end of the interconnect cable. By providing a suitable signal to the identifier activation points, the identifier can be activated, facilitating the locating and identification of the opposite end of the interconnect cable. In accordance with embodiments of the present invention, identifiers and identifier activation points may be provided at either end of the interconnect cable. In accordance with other embodiments of the present invention, an identifier can be activated using a switch at another end of the interconnect cable.

In accordance with further embodiments of the present invention, a detection probe tool may be provided. The detection probe tool, when mated to identifier activation points, can be activated to provide a suitable signal to in turn activate the identifier or identifiers in the interconnect cable. Accordingly, embodiments of the present invention may include a probe tool that provides an electrical signal at a suitable voltage for activating the identifier or identifiers. In accordance with further embodiments of the present invention, the probe tool may provide a modulated signal, to assist in distinguishing multiple interconnect cable ends from one another simultaneously.

In accordance with other embodiments of the present invention, the identifier may be interconnected to a single identifier activation point using a single identifier signal line. Where the identifier is activated by an electrical signal, a circuit may be completed by interconnecting a first contact of a probe tool with the single identifier activation point, and a second contact of the probe tool with a ground plane. In accordance with still other embodiments of the present invention, the identifier may be optically activated, and interconnected to an identifier activation point by an optical identifier signal line.

In accordance with further embodiments of the present invention, the identifier signal line or lines interconnecting an identifier to an identifier activation point or points, may comprise an identifier signal line or lines provided in addition to an interconnect signal line or lines that are used when the interconnect cable is performing its interconnect function. Alternatively, an interconnect signal line may also function as the identifier signal line, in which case the identifier signal line comprises an interconnect signal line used by the interconnect cable to carry signals as part of its interconnect function.

Additional features and advantages of the present invention will become more readily apparent from the following discussion, particularly when taken together with the accompanying drawings.

DETAILED DESCRIPTION

Figure 1:
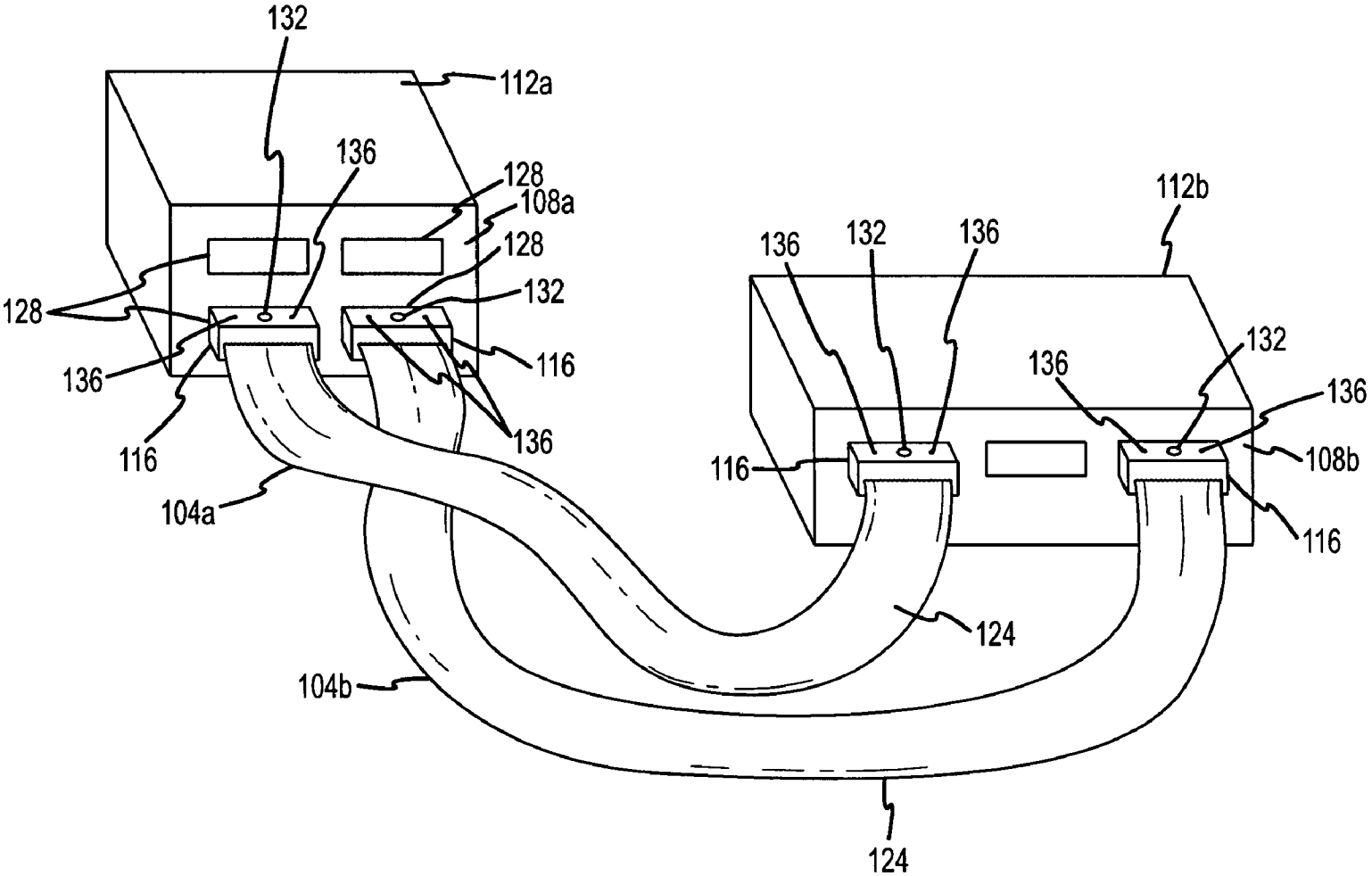
FIG. 1 depicts interconnect cables in accordance with embodiments of the present invention operatively connected to device patch panels.

With reference now to FIG. 1, interconnect cables 104 are shown operatively interconnected to patch panels 108*a–b* devices 112*a–b*. As shown in FIG. 1, each interconnect cable 104 features a first connector 116 at a first end and a second connector 116 at a second end. In addition, each interconnect cable 104 includes a body 124 having one or more signal lines, as will be described in greater detail elsewhere herein.

In general, the connectors 116 are configured to interconnect with a mating connector port 128 included in a patch panel 108 of a device 112. Accordingly, it can be appreciated that the interconnect cables 104 can be deployed to permit signals and/or power to be passed between devices 112.

Although the arrangement depicted in FIG. 1 illustrates only two interconnect cables 104*a* and 104*b*, it should be appreciated that embodiments of the present invention are not so limited. For example, interconnect cables 104 in accordance with the present invention may be applied in applications involving a very large number of interconnect cables 104, connection ports 128, and/or devices 112. Furthermore, although depicted generally as a ribbon cable in FIG. 1, it should be appreciated that an interconnect cable 104 may be provided in any configuration, as dictated or suggested by the particular application, and/or the connector ports 128 that an interconnect cable 104 is to mate with.

Each connector 116 may include an identifier 132 and one or more identifier activation points 136. As will be described in greater detail elsewhere herein, by introducing a suitable signal at an identifier activation point or points 136, an identifier 132 associated with an interconnect cable 104 can be activated, to facilitate locating an end or ends of the interconnect cable 104. Alternatively, an identifier 132 may be provided separately from a connector 116.

Figure 2:
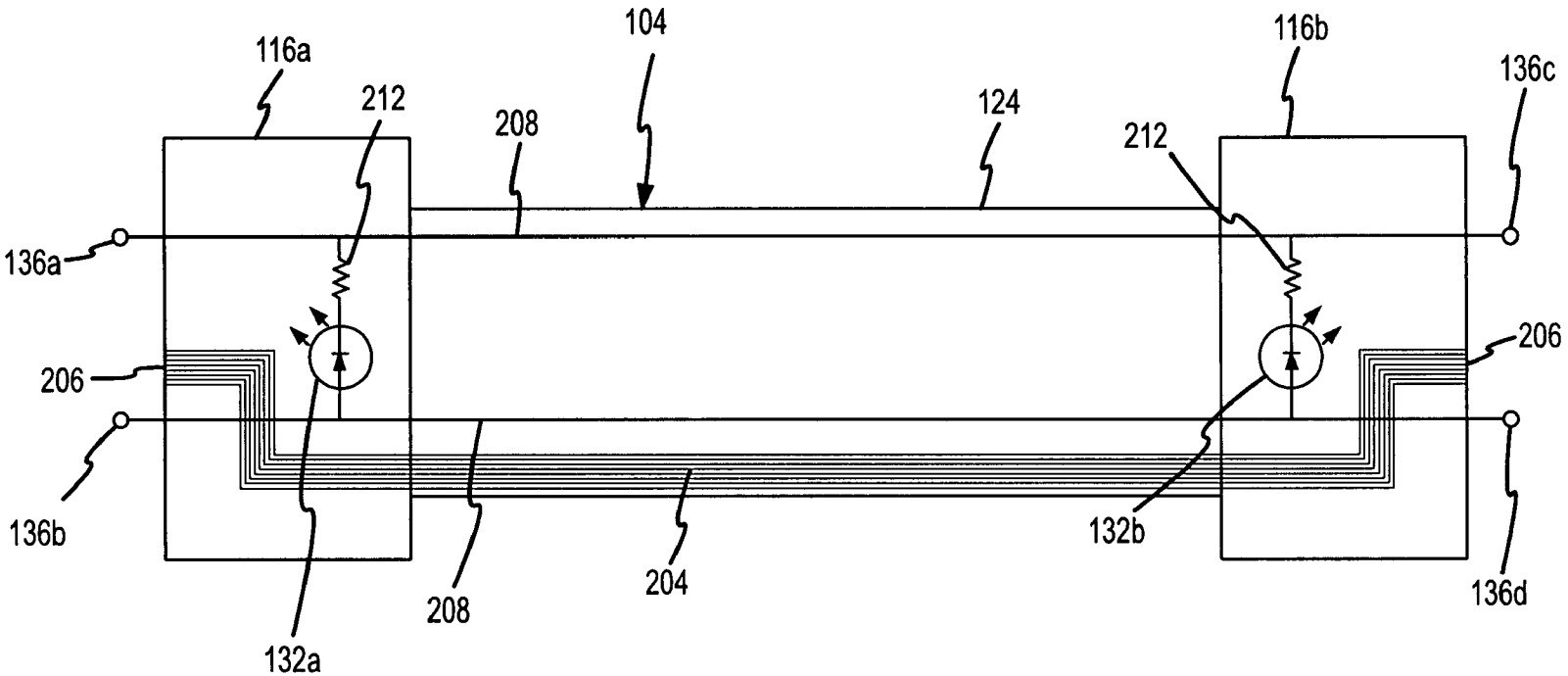
FIG. 2 is a schematic depiction of an interconnect cable in accordance with embodiments of the present invention.

With reference now to FIG. 2, components and features of an interconnect cable 104 in accordance with embodiments of the present invention are illustrated. In general, an end connector 116 provides a mechanical mating structure 206, comprising interconnection points, pins, contact points or some other structure, such that the ends of interconnect signal lines 204 provided as part of the body 124 of the interconnect cable 104 can be operably connected to a connection port 128. The signal lines 204 can comprise electrically conductive signal or optical signal lines. Accordingly, an interconnect cable 104 in accordance with embodiments of the present invention may function to operably interconnect devices 112 by providing interconnect signal lines 204 over which signals, including communications, data or power signals, can be passed. In addition, each end connector 116 may provide one or more identifier activation points 136 that are interconnected to an identifier signal line 208. In particular, identifier signal lines 208 provided as part of the interconnect cable 104 interconnect the identifier activation points 136 to the identifier or identifiers 132 associated with the interconnect cable 104. As can be appreciated by one of skill in the art from the description provided herein, an identifier signal line 208 can comprise an electrically conductive or optical signal line.

The identifier 132 may be any device that, when activated, emits a human-perceptible signal to assist in locating the associated end of the interconnect cable 104. Accordingly, examples of identifiers 132 include devices that emit visible signals and/or audible signals. Accordingly, particular examples of identifiers 132 include light emitting diodes (LEDs), incandescent lamps, fluorescent lamps, buzzers, and speakers. In addition, an interconnect cable 104 may include associated circuitry 212 as may be required for proper activation of an identifier 132 in response to an excitation signal at the identifier activation points 136.

In the embodiment illustrated in FIG. 2, both identifiers 132*a* and 132*b* are activated when a suitable electrical signal is introduced across complementary identifier activation points 136. For example, by introducing an electrical signal having a suitable voltage and polarity between identifier activation points 136*a* and 136*b*, or 136*c* and 136*d*, both identifiers 132*a* and 132*b* can be activated. As can be appreciated by one of skill in the art from the description provided herein, alternate arrangements are possible. For instance, an identifier 132*a* associated with a first end connector 116*a* may have a dedicated set of identifier signal lines 208 interconnected to identifier activation points 136 associated with the second end connector 116*b*, such that by providing an activation signal at the identifier activation points of the second connection 116*b*, the identifier 132*a* associated with the first end connector 116*a* will be activated, but any other identifier, for example such as may be associated with the second end connector 116*b*, will not be activated.

It should also be appreciated that identifiers 132 are not limited to devices activated by electrical signals. For instance, an identifier 132 may comprise an optical signal output that is activated by introducing a suitable optical signal at a single identifier activation point 136. According to such an embodiment, the identifier activation point 136 and the identifier signal line 208 comprise optical devices. For instance, the identifier activation point 136 may comprise a lens assembly, and the identifier signal line 208 may comprise an optical fiber. Similarly, the identifier 132 according to such an embodiment may comprise a lens. Furthermore, it should be appreciated that an optically activated arrangement can be implemented using a single activation point 136 and a single identifier signal line 208.

Figure 3:
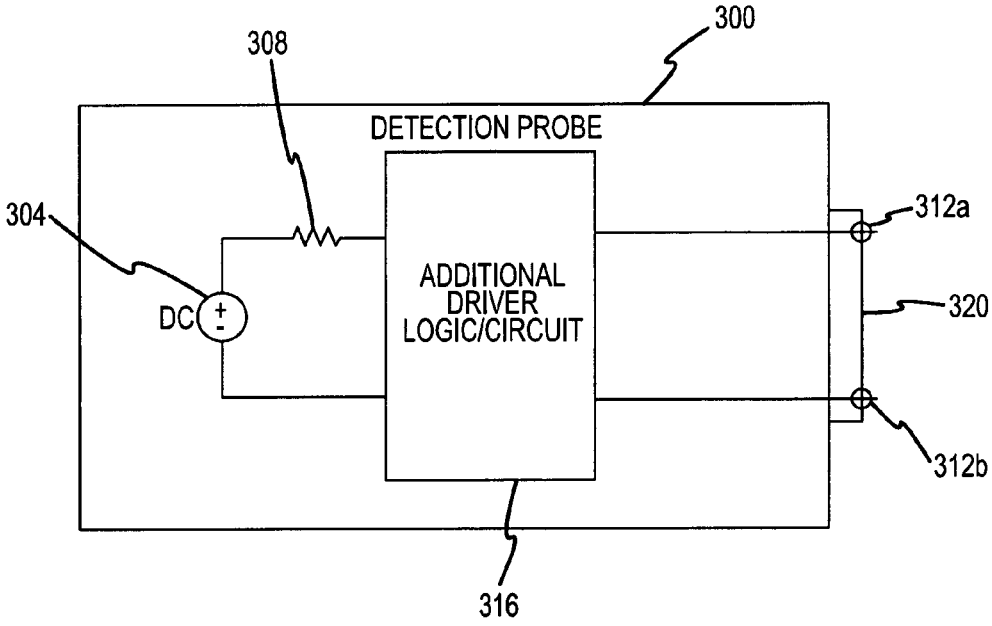
FIG. 3 is a schematic depiction of a detection probe tool in accordance with embodiments of the present invention.

With reference now to FIG. 3, a detection probe device or tool 300 in accordance with embodiments of the present invention using electrically activated identifiers 132 is illustrated. In general, the detection probe 300 includes a power source 304, driver circuitry 308, and first 312*a* and second 312*b* probe connection points. Additional driver logic or circuitry 316 may also be provided. The detection probe 300, when activated, can be used to cause an identifier 132 associated with an interconnect cable 104 to produce an output signal by placing the probe connection points 312 in contact with a pair of identifier activation points 136. As illustrated in FIG. 3, the power source 304 may comprise a direct current (DC) source, and the driver circuit 308 may comprise a resistor. Additional driver logic or circuitry 316 may include a switch, and/or circuitry for modulating the signal provided by the power source 304 and driver circuit 308. As can be appreciated by one of skill in the art from the description provided herein, the probe connection points 312 may be associated with a housing or locating structure 320 to facilitate placing the probe connection points 312 in operative contact with the identifier activation points 136.

In general, the particular makeup and configuration of a detection probe 300 will depend on the type or types of identifiers 132 that the detection probe 300 is designed to activate. Accordingly, embodiments of a detection probe 300 may alternatively include a power supply 304 comprising an alternating current (AC) source, such as from a line source. Furthermore, it can be appreciated from the description provided herein that the various components of the detection probe 300 can be configured to provide other than an electrical signal at a probe connection point 312. For example, an optical output may be provided by a probe connection point 312.

Figure 4:
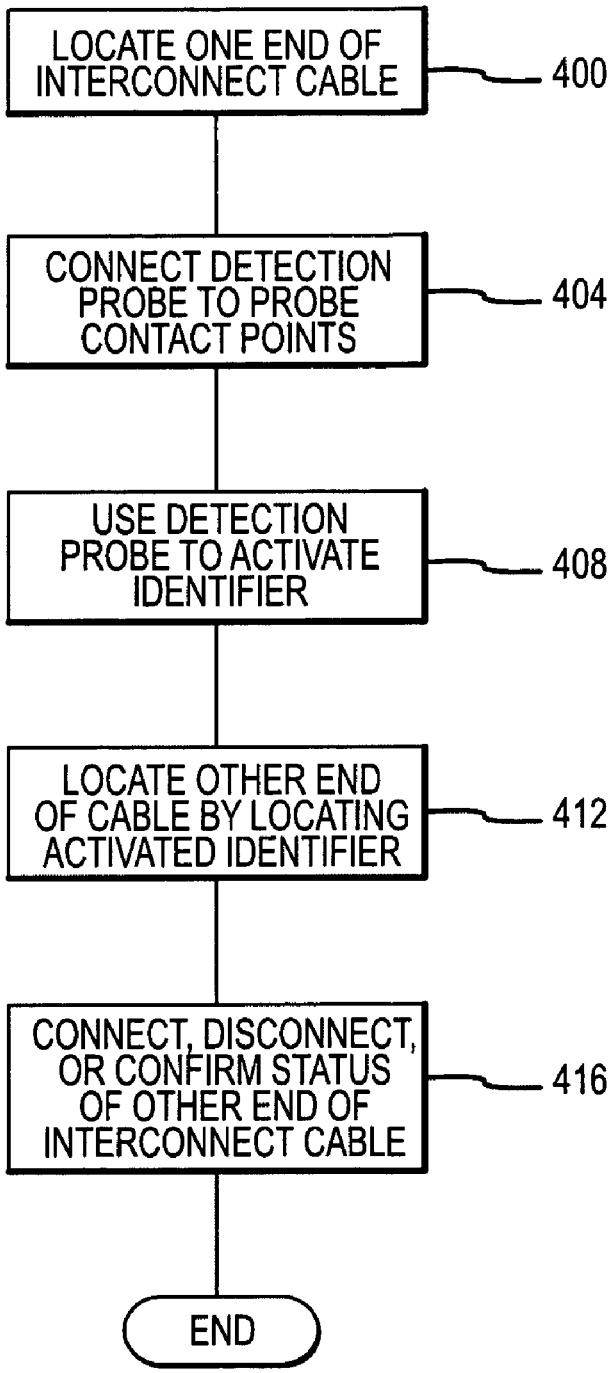
FIG. 4 is a flowchart illustrating aspects of the operation of a system in accordance with embodiments of the present invention.

With reference now to FIG. 4, aspects of the use of a system in accordance with embodiments of the present invention are illustrated. Initially, at step 400, one end of an interconnect cable 104 is located. In particular, one end of an interconnect cable 104 that a user wishes to verify the position of, or to change an existing connection is located. At step 404, the probe connection points 312 of a detection probe device 300 are connected to the probe contact points (i.e., the identifier activation points) 136 at the located end of the interconnect cable 104. The detection probe device 300 is then turned on to activate an identifier 132 associated with the interconnect cable 104 (step 408).

Having activated the identifier 132, the user can more easily identify the opposite end of the interconnect cable 104. Accordingly, at step 412, the user locates the other end of the interconnect cable 104 by locating the activated identifier 132 (412). The user may then connect, disconnect, or confirm the status of the other end of the interconnect cable 104 (step 416).

From the description provided herein, it can be appreciated that embodiments of the present invention provide an interconnect cable 104 having an end or ends that can be positively identified by providing a suitable excitation or activation signal. Although various embodiments described herein feature identifiers 132 and identifier activation points 136 for activating the identifiers 132 at either end of an interconnect cable 104, the present invention is not so limited. For instance, embodiments may include a single set of activation points 136 at one end of an interconnect cable 104 and an identifier 132 at the opposite end of the interconnect cable 104.

In addition, although an interconnect cable having electrically activated identifiers 132 has been illustrated in which two identifier activation lines 208 are provided, the present invention is not so limited. For instance, an identifier 132 may be interconnected to an identifier activation point 136 by an interconnect signal line 204. In particular, such an arrangement may be applied where the interconnect signal line 204 carries signals, during normal operation of the interconnect cable 104 that are insufficient to activate the identifier 132, and/or in which interconnection to an identifier 132 will not adversely affect the transmission of signals. In accordance with still other embodiments of the present invention, an identifier signal line 208 may be replaced by a ground plane established or completed by a conductor or conductors that are provided by a structure external to the interconnect cable 104.

Figure 5:
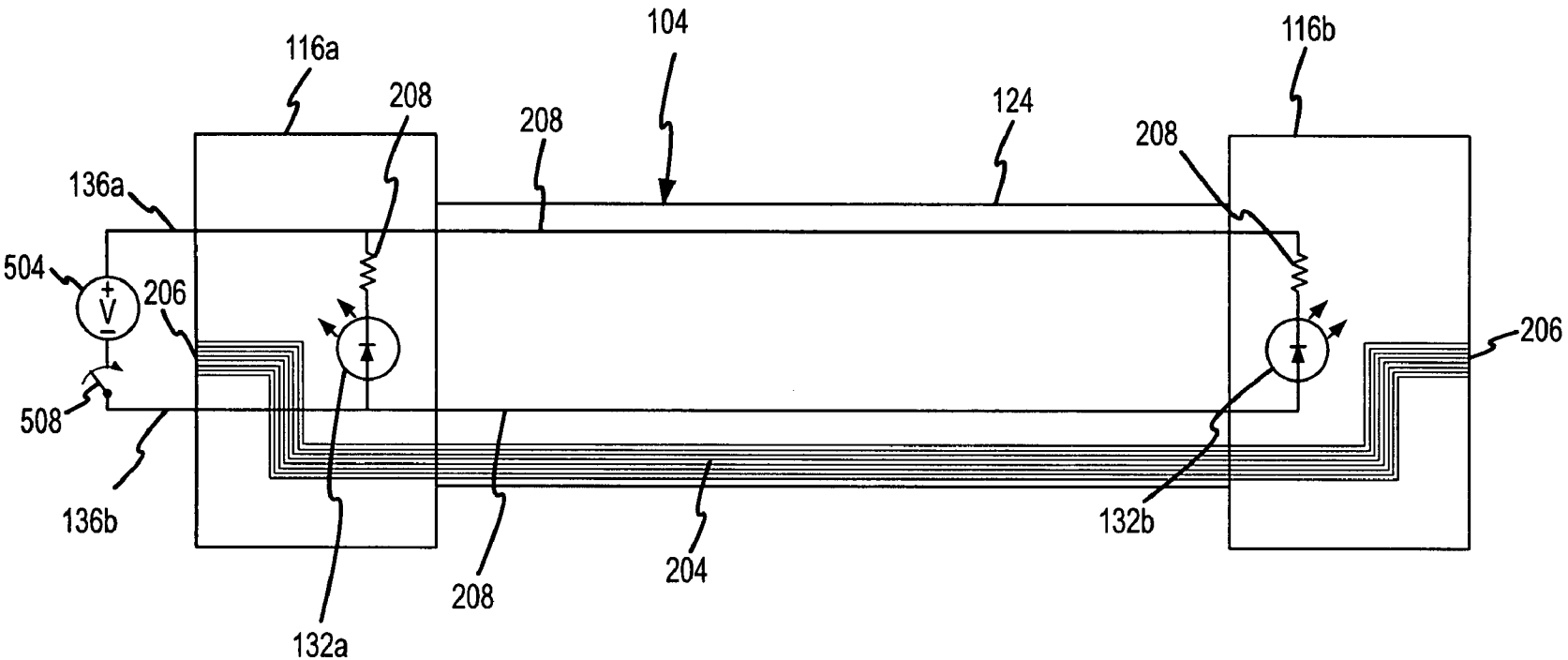
FIG. 5 is a schematic depiction of an interconnect cable in accordance with other embodiments of the present invention.

In accordance with still other embodiments of the present invention, an interconnect cable 104 is provided having an identifier or identifiers 132 that can be operated without requiring the use of a detection probe 300. Such an embodiment is illustrated in FIG. 5. As shown in FIG. 5, an interconnect cable 104 having identifiers 132 that can be operated independently of a detection probe 300 need not be provided with identifier activation points. Instead, a power source 504 in series with a switch 508 can be provided as part of the interconnect cable 104. In accordance with further embodiments, a power source 504 and associated switch 508 can be provided at either end of an interconnect cable 104. In accordance with still other embodiments of the present invention, a single power source 504 can be combined with dual pole switches at either end of the interconnect cable 104. A power source 504 can be a DC, AC or other suitable source of power for operating an identifier or identifiers 132. Alternatively or in addition, power for activating an identifier 132 can be supplied by a pin or pins of a connector port 128 to which an end of the interconnect cable 104 is attached. The switch 508 may be manually operated, for example by a technician confirming the location and/or identity of an interconnect cable 104, or trouble shooting patch panels 108 of interconnected devices 112. In accordance with still other embodiments of the present invention, a switch 508 included as part of an interconnect cable 104 may itself be operated by another device, for example by a detection probe 300.

Although interconnect cables 104 having two ends have been described in connection with certain examples provided herein, it should be appreciated that embodiments of the present invention are not so limited. For example, interconnect cables 104 having more than two ends, such as may be provided as part of a wiring harness, may be provided having an identifier 132 and/or identifier activation points 136 associated with some or all of the ends.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include the alternative embodiments to the extent permitted by the prior art.

The invention claimed is:

1. A system for identifying the ends of an interconnect cable, comprising:

an interconnect cable having at least first and second ends, said interconnect cable including:

at least a first conductive element extending from about said first end to about said second end of said interconnect cable;

a second conductive element extending from about said first end to about said second end of said interconnect cable;

a first identifier interconnected to said first conductive element and to said second conductive element, wherein said first identifier emits an identification signal in response to an applied voltage;

a power source; and at least a first switch, wherein in a closed position said switch interconnects said power source to said first identifier.

2. The system of claim 1, wherein said interconnect cable further includes:

a first connector at said first end of said interconnect cable;

a second connector at said second end of said interconnect cable; and a third conductive element extending from said first connector to said second connector, whereby said third conductor is operable to carry interconnect signals.

3. The system of claim 1, wherein said interconnect cable further includes:

a first connector at said first end of said interconnect cable;

a second connector at said second end of said interconnect cable; and a plurality of interconnect signal conductors extending from said first connector to said second connector.

4. The system of claim 1, wherein said interconnect cable further comprises:

a first identifier activation point, wherein said first identifier activation point permits conductive contact with said first conductive element;

a second identifier activation point, wherein said second identifier activation point permits conductive contact with second conductive element; and wherein said system further comprises a detection probe, including:

a power supply;

a driver circuit;

a first probe, wherein said first probe is interconnected to a first one of a negative pole of said power supply and a positive pole of said power supply by said driver circuit, and a second probe, wherein said second probe is interconnected to a second one of said negative pole of said power supply and said positive pole of said power supply, wherein said detection probe operates to apply a voltage to said first and second identifier activation points to cause said first identifier to emit said identification signal.

5. The system of claim 4, further comprising:

a third identifier activation point, wherein said third identifier activation point permits conductive contact with said first conductive element; and a fourth identifier activation point, wherein said fourth identifier activation point permits conductive contact with said second conductive element.

6. The system of claim 5, wherein said third and fourth identifier activation points are located at about said second end of said interconnect cable.

7. The system of claim 4, wherein said power supply comprises a direct current source.

8. The system of claim 4, wherein said driver circuit comprises a resistor.

9. The system of claim 4, wherein said driver circuit comprises a signal modulator that operates to modulate a current provided by said power supply.

10. The system of claim 4, wherein said first identifier is located at about said second end of said interconnect cable.

11. The system of claim 10, wherein said first and second identifier activation points are located at about said first end of said interconnect cable.

12. The system of claim 10, further comprising:

a second identifier interconnected to said first conductive element and to said second conductive element at about said second end of said interconnect cable.

13. The system of claim 1, wherein said first conductive element comprises an interconnect signal line.

14. The system of claim 1, wherein said first and second conductive elements comprise interconnect signal lines.

15. The system of claim 1, further comprising a ground circuit, wherein said second conductive element comprises a part of said ground circuit, wherein said ground circuit is completed at least in part through a conductor included in a structure external to said interconnect cable.

16. The system of claim 1, wherein said first identifier comprises one of a light source and an audible output device.

17. An interconnect cable, comprising:

a first identifier activation point located proximate to a first end of said interconnect cable;

a first identifier located proximate to a second end of said interconnect cable;

a first identifier signal line electrically interconnecting said first identifier activation point to said first identifier;

a first connector at said first end of said interconnect cable, wherein said first connector has at least a first interconnection point;

a second connector at said second end of said interconnect cable, wherein said second connector has at least a first interconnection point; and a first interconnection signal line interconnected to said first interconnection point of said first connector at a first end and interconnected to said first interconnection point of said second connector at a second end, wherein said first interconnect signal line comprises one of said first identifier signal line and a first interconnect signal line;

a second identifier activation point located proximate to said second end of said interconnect cable;

a second identifier located proximate to said first end of said interconnect cable;

a second identifier signal line electrically interconnecting said second identifier activation point to said second identifier, wherein said first identifier is not electrically interconnected to said second identifier activation point and wherein said second identifier is not electrically interconnected to said first identifier activation point.

18. The interconnect cable of claim 17, further comprising:

a second identifier activation point located proximate to said first end of said interconnect;

a second identifier signal line interconnected to said first identifier, wherein said second conductor element is one of interconnected to said second identifier activation point and selectively interconnected to said second identifier activation point.

19. The interconnect cable of claim 17, wherein said first identification signal line is operable to carry a signal when said interconnect cable is used to interconnect first and second components.

20. The interconnect cable of claim 17, further comprising:

a second identifier located proximate to a second end of said interconnect cable.

21. The interconnect cable of claim 20, further comprising:

a third identifier activation point; and a fourth identifier activation point, wherein said third and fourth identifier activation points are located proximate to said first end of said interconnect cable, and wherein said first and second identifiers emit an identifying signal in response to a voltage applied between one of said first and third identifier activation points and one of said second and fourth identifier activation points.

22. The interconnect cable of claim 17, wherein said first identifier is activated by an electrical signal, wherein said first identifier signal line is electrically conductive, and wherein said first activation point comprises an electrically conductive contact point.

23. The interconnect cable of claim 17, wherein said first identifier is activated by an optical signal, wherein said first identifier signal line comprises a fiber optic cable, and wherein said first identifier activation point is operable to receive an optical signal for transmission by said first identifier signal line to said first identifier.

24. The interconnect of claim 17, wherein said first identifier comprises one of a light emitter and a sound emitter.

25. A system for identifying the ends of an interconnect cable, comprising:

first means for emitting a human perceptible signal located at a first end of said interconnect cable;

first means for receiving an identification signal;

means for interconnecting said first means for emitting to said means for receiving an identification signal;

first means for interconnecting said interconnect cable to an interconnect signal source;

second means for interconnecting said interconnect cable to an interconnect signal receiver;

means for carrying an interconnect signal between said first means for interconnecting and said second means for interconnecting; and means for selectively energizing said first means for emitting a human perceptible signal, wherein said means for selectively energizing includes means for supplying power that is provided as part of said interconnect cable and switch means for selectively interconnecting said means for supplying power to at least said first means for emitting a human perceptible signal.

26. The system of claim 25, wherein said means for energizing includes at least first probe means, wherein said first means for identifying is activated when said at least first probe means is placed in operative contact with said first means for receiving an identification signal.

27. The system of claim 26, further comprising:

second means for receiving an identification signal, wherein said means for energizing further includes second probe means, wherein said first means for identifying is activated when said first probe means is placed in operative contact with said first means for receiving an identification signal and said second probe means is placed in operative contact with said second means for receiving an identification signal.

28. The system of claim 25, further comprising:

second means for emitting a human perceptible signal located at a second end of said interconnect cable; and second means for receiving an identification signal, wherein said means for interconnecting said first means for emitting a human perceptible signal to said means for receiving an identification signal also interconnects said second means for emitting a human perceptible signal to said second means for receiving an identification signal.

29. The system of claim 28, wherein said first means for receiving an identification signal comprises first and second contact points, and wherein said second means for receiving an identification signal comprises first and second contact points.

30. An interconnect cable, comprising:

a first end;

a second end;

a first identifier at said first end of said interconnect cable;

a power source;

a first switch at said second end of said interconnect cable operable to selectively interconnect said power source to said first identifier;

a first identifier signal line, wherein said first identifier signal line interconnects said first identifier and said power source at least when said first switch is operated to interconnect said power source and said first identifier.

31. The interconnect cable of claim 30, further comprising:

at least a first interconnect signal line.

32. The interconnect cable of claim 31, further comprising:

a first end connector at said first end of said interconnect cable, said first end connector including a first mating structure interconnected to a first end of said interconnect signal line; and a second end connector at said second end of said interconnect cable, said second end connector including a second mating structure interconnected to a second end of said interconnect signal line.

33. The interconnect cable of claim 32, wherein said first identifier is included in said first end connector.

34. The interconnect cable of claim 32, wherein said first switch is included in said second end connector.

35. The interconnect cable of claim 30, further comprising:

a second identifier signal line, wherein said second identifier signal line is interconnected to said first identifier.

36. The interconnect cable of claim 30, further comprising:

a second identifier, wherein said second identifier is interconnected to said first identifier signal line.

37. The interconnected cable of claim 30, further comprising:

a second identifier at said second and first said interconnect cable;

a second switch at said first end of said interconnect cable operable to selectively interconnect said power source to said second identifier.

* * * * *